US009340939B2

(12) United States Patent
Kovalev et al.

(10) Patent No.: US 9,340,939 B2
(45) Date of Patent: May 17, 2016

(54) AUTOMATIC ADJUSTABLE VALVE

(71) Applicant: Hyrdoplus, Rueil Malmaison (FR)

(72) Inventors: Stanislav Vasilyevich Kovalev, Moscow (RU); Gertrud Fedorovich Onipchenko, Moscow (RU); Andrei Gennadievich Zyuzin, Moscow (RU); Nicolas Francois Daniel Mathis, Paris (FR)

(73) Assignee: HYDROPLUS, Rueil Malmaison (FR)

( * ) Notice: Subject to any disclaimer, the term of this patent is extended or adjusted under 35 U.S.C. 154(b) by 40 days.

(21) Appl. No.: 14/403,249

(22) PCT Filed: May 16, 2013

(86) PCT No.: PCT/FR2013/051076
§ 371 (c)(1),
(2) Date: Nov. 24, 2014

(87) PCT Pub. No.: WO2013/175102
PCT Pub. Date: Nov. 28, 2013

(65) Prior Publication Data

US 2015/0107697 A1 Apr. 23, 2015

(30) Foreign Application Priority Data

May 22, 2012 (FR) ..... 12 54672

(51) Int. Cl.
*E02B 3/02* (2006.01)
*E02B 7/20* (2006.01)
(Continued)

(52) U.S. Cl.
CPC ... *E02B 3/02* (2013.01); *E02B 3/00* (2013.01); *E02B 7/205* (2013.01); *E02B 7/46* (2013.01); *Y10T 137/7339* (2015.04)

(58) Field of Classification Search
CPC ..... E02B 3/00; E02B 3/02; E02B 7/205; E02B 7/46; E02B 3/104; E02B 7/20; E02B 9/025; Y10T 137/7339
See application file for complete search history.

(56) References Cited

U.S. PATENT DOCUMENTS 1,938,675 A * 12/1933 Young ..... E02B 7/46 405/101
2,551,678 A 5/1951 Jermar
3,926,002 A * 12/1975 Ludvigsson ..... E02B 7/20 405/5

(Continued)

FOREIGN PATENT DOCUMENTS

GB 24759 3/1915
WO WO 2007/000508 1/2007

OTHER PUBLICATIONS

PCT/FR2013/051076 International Search Report dated Sep. 17, 2013 (4 pages including English translation).

(Continued)

*Primary Examiner* — John Kreck
*Assistant Examiner* — Carib Oquendo
(74) *Attorney, Agent, or Firm* — Brinks Gilson & Lione; G. Peter Nichols

(57) ABSTRACT

A valve that switches between open and closed states includes a pivoting body having a reservoir, at least one filling port for filling the reservoir and at least one port for draining the reservoir, and a counterweight. The valve further includes a first conduit separate from the body, connected to the filling port, and having a water intake located at a higher position than the filling port, whether the valve is open or closed.

9 Claims, 7 Drawing Sheets

(51) Int. Cl.
*E02B 7/46* (2006.01)
*E02B 3/00* (2006.01)

(56) References Cited

U.S. PATENT DOCUMENTS 4,027,487 A * 6/1977 Alexandre ..... G05D 9/02 405/97
4,449,851 A * 5/1984 Combes ..... E02B 7/205 405/100
4,963,057 A * 10/1990 Fournier ..... E02B 7/42 405/100

OTHER PUBLICATIONS

French Patent Application No. 1254672 Preliminary Search Report dated Jan. 29, 2013 (2 pages).

* cited by examiner

AUTOMATIC ADJUSTABLE VALVE

This application claims priority to International Application No. PCT/FR2013/051076 filed May 16, 2013 and French Patent Appln. No. 1254672 filed May 22, 2012; the entire contents of each are incorporated herein by reference.

BACKGROUND

The present invention relates to the field of hydraulics and can be used for closing waterways in dams and jetties or for regulating the water level in ponds and rivers.

SUMMARY

Like the solution according to the invention, WO 2007000508 discloses an adjustable automatic valve switching between respectively open and closed states and comprising for this purpose a body suitable for pivoting about a horizontal axis, the body having:

a reservoir provided essentially above said axis, at least one filling port for a water inlet for filling the reservoir and at least one port for draining the reservoir, and a counterweight below said axis, when the valve is in the closed state.

However, in WO2007000508, the water inlet, or intake, and thus the filling port, is mounted on the top point of the valve body. This water intake provided on the body interferes with the momentums applied to the body.

One problem to be solved is thus that of arranging the supply structure (water intake/filling port) so as not to (or less than in solution according to WO 2007000508) interfere with the stability of the body, in closed and open positions.

One proposed embodiment consists of said valve comprising a first conduit separate from the body, connected to the filling port, and having a water intake located at a higher position than the filling port, whether the valve is open or closed.

This will result in an optimised hydraulic efficiency and a greater floating body discharge capacity.

By means of this water intake level which is adjustable in respect of position (particularly height) and above all independently from the position (angular; open or closed) of the body, it will be possible to uncouple supply-related hydraulic stress from stress associated with the stability of the body and enable greater flexibility for optimised adjustment of the actuation (opening) and return (closure) levels.

The first conduit thus has one end connected to the reservoir filling port and one end which is thus independent from the body, the water intake, corresponding to a raised filling level. This means that the reservoir is filled when the water level reaches and/or passes this raised filling level with respect to the level of the filling port formed in the valve body.

To enable any movement of the valve body in one embodiment wherein the conduit is preferably fixed, or to be able to change the conduit, for example for a maintenance procedure, it is envisaged that the first conduit may be suitable for being disconnected from the filling port, by moving the body.

In one embodiment, it is envisaged that the first conduit is connected to the filling port when the valve is closed and is disconnected therefrom when the valve is open, by pivoting the body, and that the valve comprises a second conduit separate from the body, connected to the filling port when the valve is open and disconnected therefrom when the valve is closed by pivoting the body, the second conduit having a water intake located at a lower position than the water intake of the first conduit.

This ensures continuity in respect of the filling of the reservoir in the open position while the water level is above the water intake of the second conduit. Opening and closure are controlled precisely.

Alternatively, it is envisaged that the valve comprises a second conduit separate from the body, connected to the first conduit and connected, by a common section of the first and second conduits, to the filling port, permanently, whether the valve is closed or open, the second conduit having a water intake located at a lower position than the water intake of the first conduit.

So as not to destabilise the valve (for filling the reservoir) before the water level has reached the water intake of the first conduit, it is further envisaged that the second conduit can be connected to the first conduit so that the filling port is supplied with water only after supplying the first conduit with water.

So as not to destabilise the valve body before the level in the basin reaches the level of the first conduit (otherwise, supplying the reservoir for the level of the second conduit which is below the top of the body in the closed position), it is further envisaged that, the second conduit having a water intake located at a lower position than the water intake of the first conduit, this first conduit can define, downstream from the water intake of the first conduit, a siphon for supplying the filling port with water.

To prevent/limit possible leakages particularly in the filling port/conduit connection, it is further envisaged that the common section of the first and second conduits can be at least locally deformable to follow the pivoting of the body about said horizontal axis.

According to a further advantageous embodiment, at least one of the conduits is provided with means for adjusting the water level above which the reservoir is filled.

Indeed, the filling port/conduit attachment is sometimes heavy and bulky. It is thus preferable to limit changing the conduit to modify the filling level.

In this way, the water intake will advantageously have level adjusting means, which may be housed in a pier or in another remote structure, and the level of the water intake will be independent from the level of the basin. The term pier refers to a post or fixed wall of the structure containing the valve. A structure such as a dam may comprise two side walls (for support) and one or a plurality of intermediate piers. In the case of a canal, the term pier refers to the support wall on a bank.

For the purposes of simplicity, the term "pier" denotes a post in the structure positioned in the direction of the flow, whether it is a side wall, a fixed wall or an actual pier.

The means for adjusting the water level may be in the form of an end piece positioned on the filling end of the conduit. The end piece may be fitted onto the conduit and form, by means of contact, a tight connection. The end piece may have an orifice corresponding to the water intake.

Preferably, the water intake of the first conduit, when the valve is closed, is located at a higher position than the filling port and located at a higher position than the valve body in the closed position.

This enables an overflow of the upstream basin above the valve body before the reservoir starts to be filled.

When the valve is open, compared to the prior art, the raising of the water intake in relation to the position of the filling port when the body is horizontal makes it possible to stop filling the reservoir while the water level in the upstream basin is higher. The valves closes again while the water reserves in the basin are higher.

To control the filling of the reservoir and thus the counterweight of water in the valve, it is further envisaged that the water intake of the second conduit can be located at a higher position than the filling port and the body, with the valve open.

To uncouple the stress related to supply and stability of the valve body, it is further envisaged that the first conduit is preferably attached to a fixed supporting element other than the body.

This makes it possible to readily obtain the adjustable water intake level sought, in respect of position (particularly height), and particularly independently from the position (angular; open or closed) of the body.

It is also possible to envisage that the first conduit is detachably attached to a fixed supporting element other than that body from which it would thus be removable.

The advantage is the same, in a further embodiment.

Draining ports are also referred to as drains or bleeders. Preferably, at least one draining port is formed at the bottom of the reservoir so as to completely drain the reservoir.

Advantageously, the valve body will exhibit an inclination in relation to the vertical when the valve is in the closed position. As a general rule, regardless of the inclination, when the valve is in the closed position, the body is said to be in the vertical position, and when the valve is in the open position, the body is said to be in the horizontal position.

The position of the axis of rotation and the inclination of the valve body will be preferably chosen so as to minimise the quantities of counterweight required to hold the valve in the closed position and the maximum overflow before tipping, i.e. the maximum water level covering the valve without giving rise to the opening thereof.

The invention also relates to a hydraulic structure comprising an adjustable automatic valve having some or all of the above-mentioned features, and a fixed supporting element, other than the body, to which the first conduit is attached.

The supporting element may comprise at least one pier or another fixed structural element, such as a side wall of the structure, or a side wall of a canal.

Alternatively, for flexible use according to the circumstances, it has been envisaged that the valve body may:

be housed between two piers; the axis thereof may then be housed in the piers or equally well be attached to platforms.

be mounted directly on platforms via a sill. A plurality of bodies may be mounted side by side without necessarily having intermediate piers.

To simplify production, installation and maintenance, the means for adjusting the water level may comprise a plate comprising a hole. In this way, the link between the first conduit and the filling port will preferably be direct, i.e. the filling port will be a hole whereto the first conduit is connected, with if required an intermediate element, acting as a seal for example, or extending the filling port from the reservoir.

With the above, it will thus be possible to adjust the length and orientation of the conduit(s) and the height of the water intake independently from the design of the valve body (such as for example the determination of the reservoir volume), facilitating the adaptation of the valve to any facility. For example, such a valve may be adapted to a previously existing structure (for example a dam or a canal).

Advantageously, an attachment will connect the first conduit to an element other than the valve body, for example a pier of a structure wherein the valve would be installed.

According to one advantageous embodiment, the filling port will be situated in a side face of the valve body. Such a positioning makes it possible to isolate the filling port from the basin and avoid any accidental supply of the reservoir. Moreover, it is then possible to position the conduit away from the flow. The conduit is thus less eroded by the current.

The second conduit will preferably have a water intake situated at a lower level than the water intake of the first conduit. Also, advantageously, the first and second conduits are provided with means for adjusting the water level above which the reservoir is filled, for the same reasons as above.

Following regular flood waters, the counterweight holds the valve in the closed position, i.e. the body in the vertical position. While the water level is below the top point of the body in the vertical position of the valve, or "crest", the valve acts as a tight partition. The water is retained upstream.

For levels between the crest and a first level (high level), situated above the crest, the water overflows over the valve body. The water intake of the first conduit would thus correspond to the "high level".

When the water level reaches or passes the high level, the reservoir is filled. Filling the reservoir, in conjunction with hydrostatic and dynamic loads, causes the valve to tip to the open position.

The minimum reservoir volume is calculated so that, once filled via the first conduit, it triggers the rotation of the body from the vertical to the horizontal position thereof. Following tipping, the flow above the body and the water in the reservoir hold the body in the horizontal position thereof. The reservoir is then supplied via the second conduit while the level has not fallen below a second level (low level).

The presence of the first conduit thus makes it possible to only fill the reservoir, and thus open the valve, for significant flood waters for which the overflow is not sufficient to restore the sought water level.

Once the valve is in the open position, with the valve body tipped, and if the conduits are suitable for connection/disconnection, the filling port of the body is then connected to the second conduit.

The second conduit then has one end receiving water via the filling port of the reservoir, with the valve open, and one filling end corresponding to a raised draining level, also referred to as the "low level" (the water intake thereof, at a higher position than the filling port, with the valve open). The reservoir continues to be filled when the water level reaches and/or passes the raised draining level. The filling end of this second conduit corresponds to the "low level".

While the water level does not fall below the low level, the reservoir is saturated and the valve remains open.

Once the water level is below the low level, the reservoir is progressively drained, and the valve is straightened and the valve is closed again.

The presence of the second conduit makes it possible to stop filling the reservoir while the water level is higher. The water reserves produced prior to flood waters are thus not lost following flood waters.

Preferably, the counterweight will be designed so as to return the valve body to the vertical position while the reservoir is empty but such that the flow continues to apply loads on the valve body. In this way, substantially the body will not switch from the flat position to the upright position suddenly.

When the water level reaches or passes the high level (water intake of the first conduit) while the valve is in the closed position, an overflow will preferably occur over the valve body, and the reservoir is filled via the port thereof opening into the first conduit. Once the reservoir has been filled, the valve will open by pivoting and will remain substantially flat, allowing the water to flow. The filling port will then supply the second conduit, and the reservoir will continue to be supplied until the water level reaches or passes the low level (water intake of the second conduit). Once the water level has fallen below the low level, the reservoir will be drained while the flow continues over the valve body. Once the reservoir has been drained, the valve will close again, by means of the counterweight.

The full automation and the operation of such a valve are only dependent on the water level in the supply canal and failures due to human error or a mechanical fault.

To ensure the satisfactory operation of the valve in maintenance, it is advantageous to be able to generate the tipping of the body regardless of the upstream water level. It is recommended that the minimum volume of the reservoir ensures that, in the absence of hydrostatic and hydrodynamic loads, the resultant of the momentums produced by the weight of the structure, the counterweight and the reservoir are unstable and give rise to tipping of the body.

On the structure produced, a base may be provided, i.e. a slab acting as a floor for the structure whereon the lower end of the valve will rest.

In respect of the construction conditions, it is recommended that at least one of the conduits is integrated in the supporting structure for the structure, i.e. for example machined, moulded or hollowed out in the material forming the supporting structure. A solution using an imprint corresponding to the shape of the conduit but separate therefrom will be possible. In this way, although the conduit is integrated, it will be possible to replace it.

According to one possible embodiment, the first conduit will be at least partially integrated in the supporting structure, such as a pier, such that the end thereof acting as the water intake is situated further upstream. In this way, as the upstream water level passes the water intake of the first conduit, the reservoir will be supplied.

The reservoir filling port may be formed in a side face of the body.

The valve may be designed in such a way that, when the valve tips, the level in the reservoir remains below the filling port. In this case, it is preferable for the filling port to be formed at the top of the reservoir. Water losses in the reservoir are thus limited when the panel rotates. Once in the lowered position, the filling port is in tight contact with the second conduit and the filling process resumes. Given the inlet position of the second conduit, it can be envisaged that the water will flow out via the lower end of the second conduit (i.e. the end in contact with the filling port when the body is horizontal) before contact has been completed between the end and the filling port. However, this shift in no way impedes the satisfactory operation of the valve.

It should be further noted that one advantage of the abovementioned means for adjusting the water level above which the reservoir is filled is that of enabling the adaptation of the facility, even though the conduit is difficult to modify, or formed in a structure, and thus not possible to move or replace.

The means for adjusting the water level may be in the form of an end piece positioned on the filling end of the conduit.

Particularly in the case of an integrated conduit, the end piece will preferably be in the form of a cavity covered with a plate extending from the end of the conduit. The plate will comprise a hole in this case. A plate is easy to replace and a set of plates each having a hole at different positions may be used.

BRIEF DESCRIPTION OF THE DRAWINGS

Hereinafter, an illustrated description will be given with reference to the above and wherein.

Identical elements represented in FIGS. 1 to 9 are identified with identical reference numbers.

DETAILED DESCRIPTION

Figure 1:
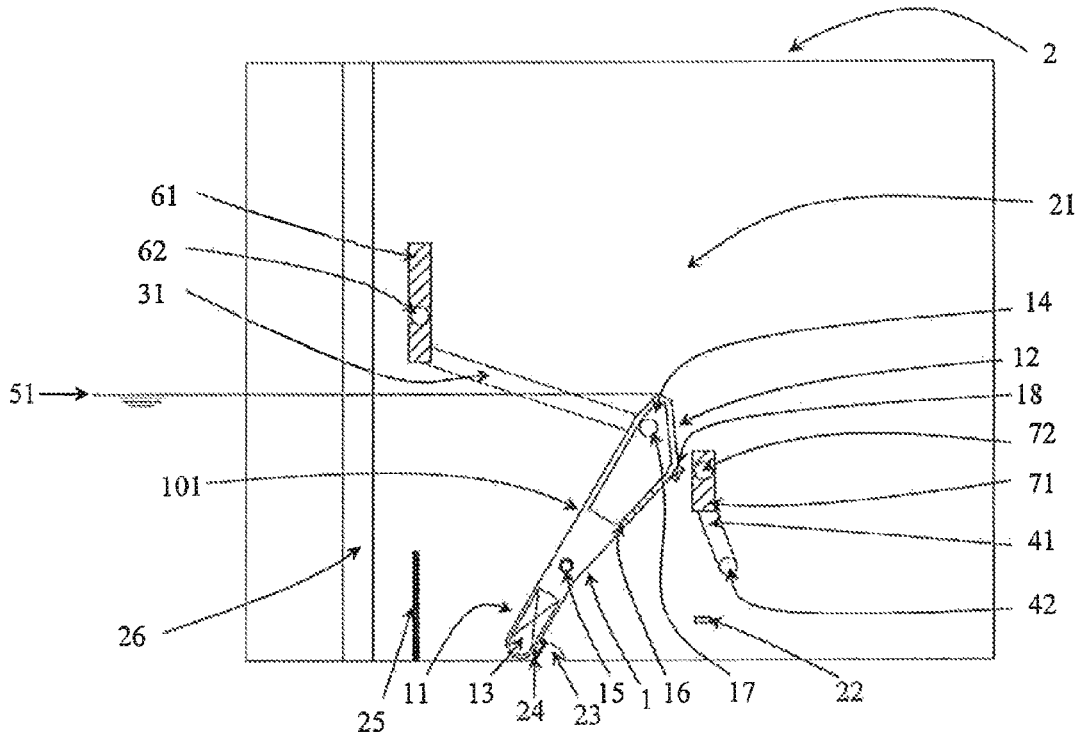
FIGS. 1 to 6 represent the operation of a valve in a structure.

A structure according to the invention essentially comprises a valve comprising a body 1, and a pier 2.

The body 1 of a valve has lower 11 and upper 12 parts, respectively.

The lower part 11 comprises a counterweight 13. The counterweight 13 is designed according to the structural requirements of the structure. The upper part 12 comprises a reservoir 14. When the valve is closed, i.e. the body 1 is in the raised position, the reservoir 14 is empty.

The body 1 has an upstream face 101, a downstream face 102, and at least one side face 103, in this case, two side faces 103.

According to this example of an embodiment, the reservoir 14 comprises a filling port 17 opening onto a side face 103, and draining orifices 16 distributed in the height and width of the reservoir such that the reservoir can be drained progressively. In this case, the draining ports 16 open onto the downstream face 102. However, it is useful that at least one draining port, or a row of draining ports, is situated at the bottom of the reservoir to be able to drain same entirely.

The upstream face 101 of the body 1 is in this case solid and continuous. It does not have a water intake. However, it has a variation in the slope in the upper part 12 of the body 1 to promote flow.

The downstream face 102 has draining ports 16, and a damper 18. When the valve is open, the damper 18 bears on an abutment 22.

A supply port 17 may be envisaged on each of the side faces 103.

The valve body 1 is rotatable about an axis 15 by means of a pivot link formed between the body 1 and the axis 15. The axis 15 may for example be positioned in recesses 27 contained in two piers 2.

The pier 2 has one face 21 oriented towards the valve.

According to the example, a single pier 2 has a first conduit 31 and a second conduit 41.

The first conduit 31 has at one end a port 32 in contact with the filling port 17 of the valve body 1 when the valve is closed, and the second conduit 41 has at one end a port 42 in contact with the filling port 17 of the valve body 1 when the valve is open.

At the other end, the first conduit 31 and the second conduit 41 each have means for adjusting the water level.

The means for adjusting the water level connected to the first conduit 31 is embodied by a cavity 33 hollowed out in the pier 2. The cavity 33 is covered with a plate 61 having a hole 62. The positioning of the hole 62 on the plate 61 thus makes it possible to adjust the filling level of the reservoir 14, i.e. the water level from which the reservoir starts to be filled.

Figure 3:
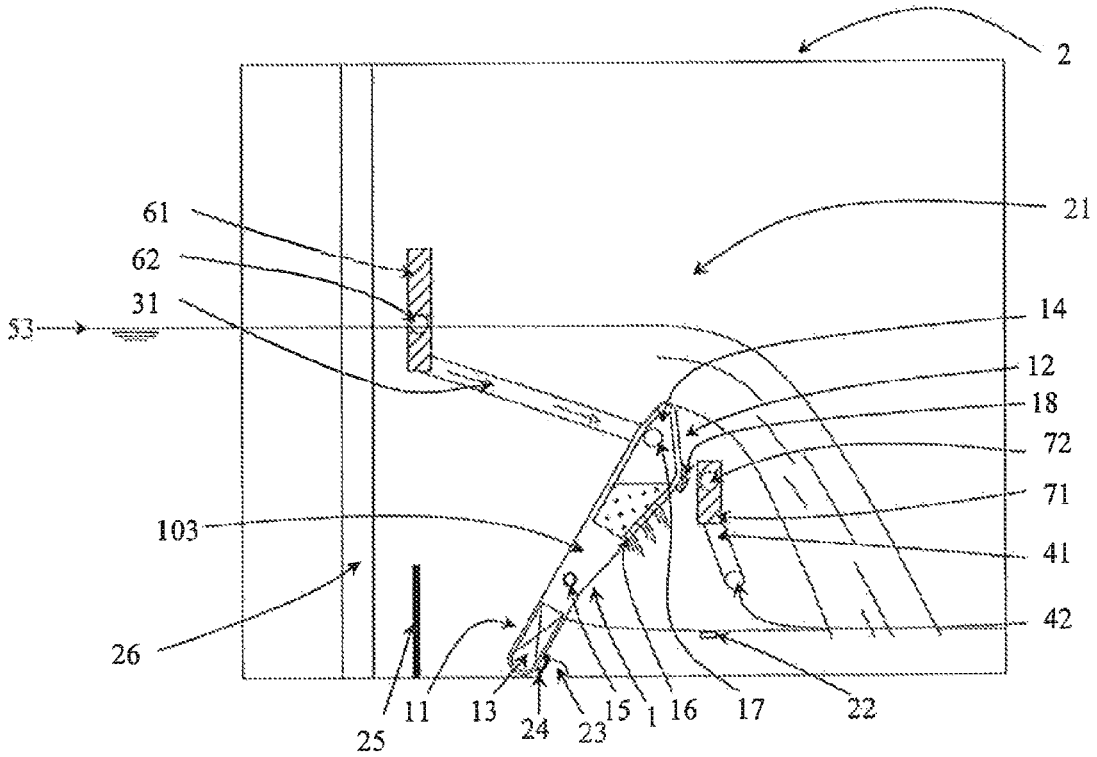
Figure 4:
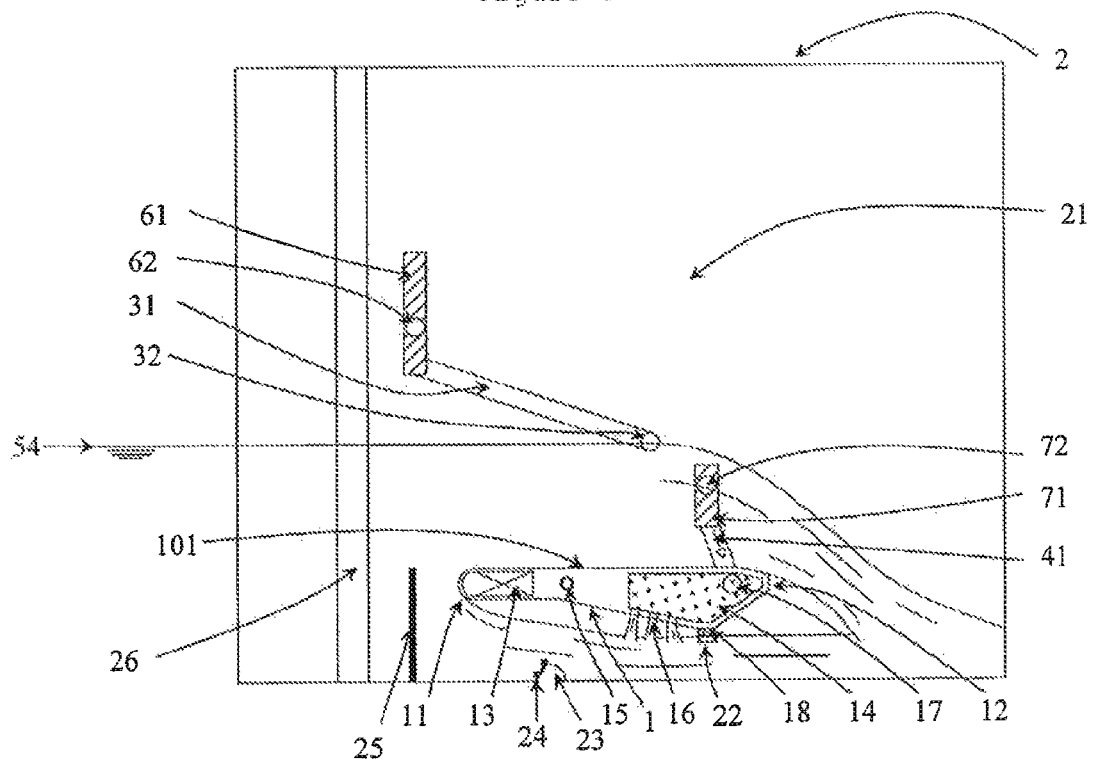

In the example, the reservoir 14 starts to be filled for a water level 53 shown in FIG. 3.

The means for adjusting the water level connected to the second conduit 41 is also embodied by a cavity 43 hollowed out in the pier 2. The cavity 43 is covered with a plate 71 having a hole 72. The positioning of the hole 72 on the plate 71 thus makes it possible to adjust the level for stopping filling of the reservoir 14, i.e. the level below which the reservoir is no longer filled.

Figure 5:
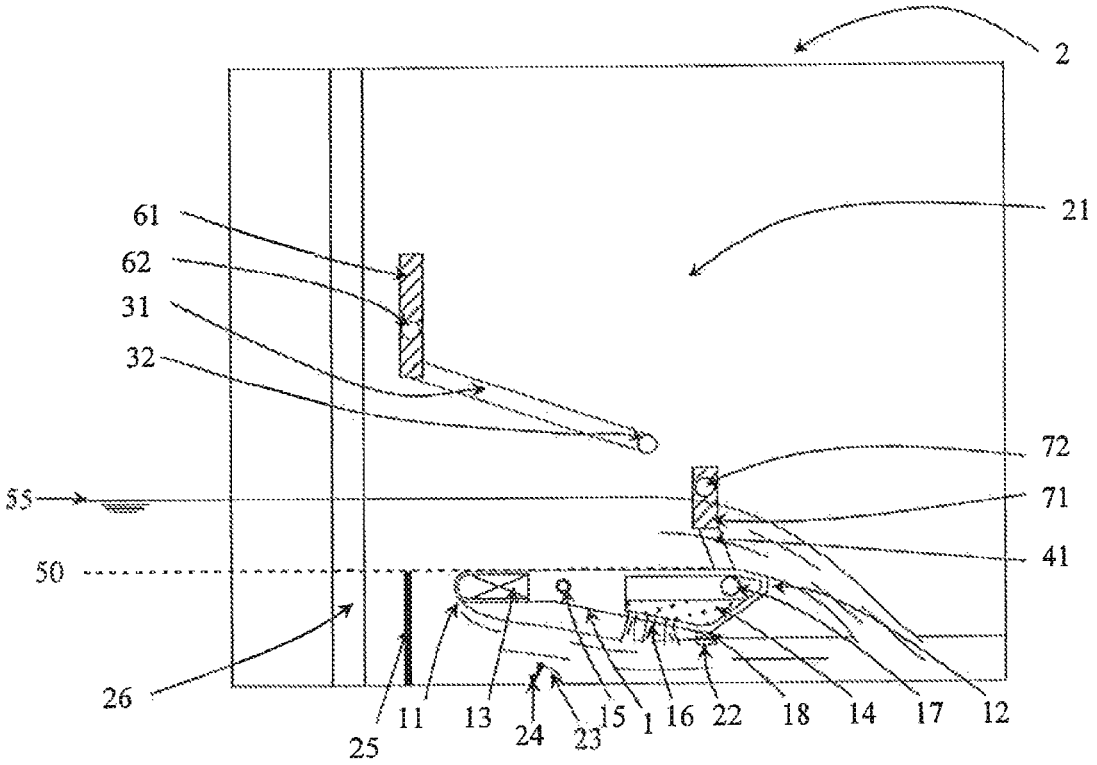

In this example, the reservoir 14 is no longer filled for a water level 55, for example, as shown in FIG. 5.

Moreover, the structure as shown further comprises a screen 25 for retaining waste and grooves 26 for installing a shutoff gate.

A base 8 having an abutment 23 is also envisaged. The abutment 23 comprises a damper 24 whereon the body 1 bears when the valve is closed.

Figure 6:
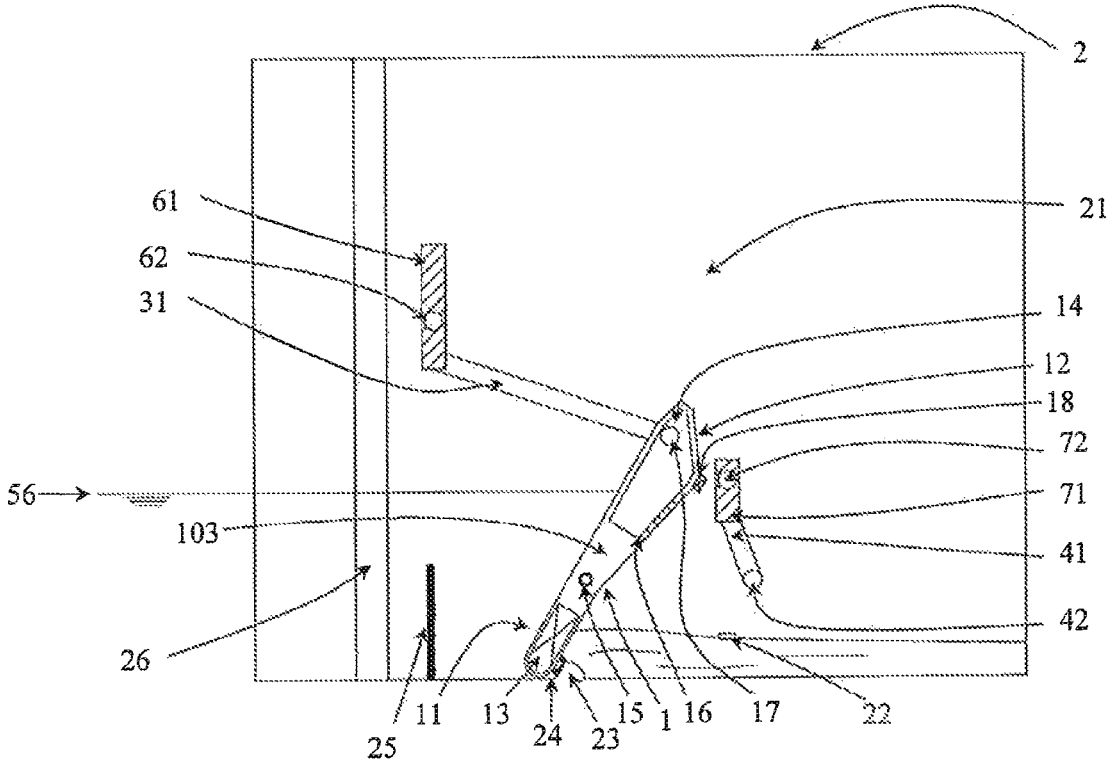
Figure 7:
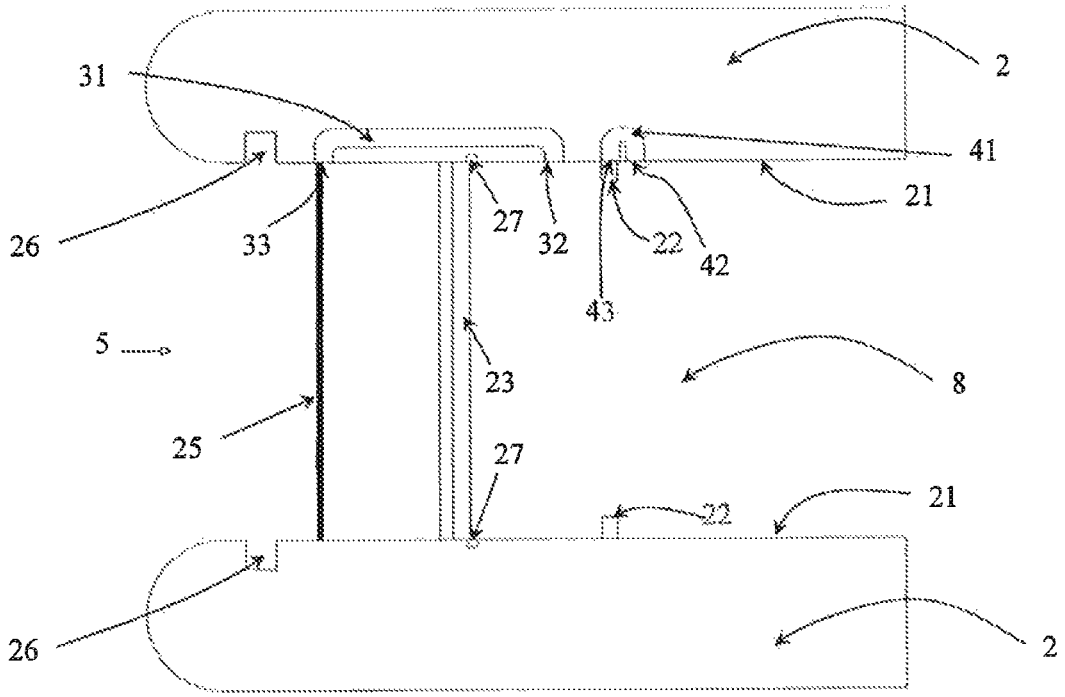
FIG. 7 represents a structure comprising two piers, with no valve.
Figure 8:
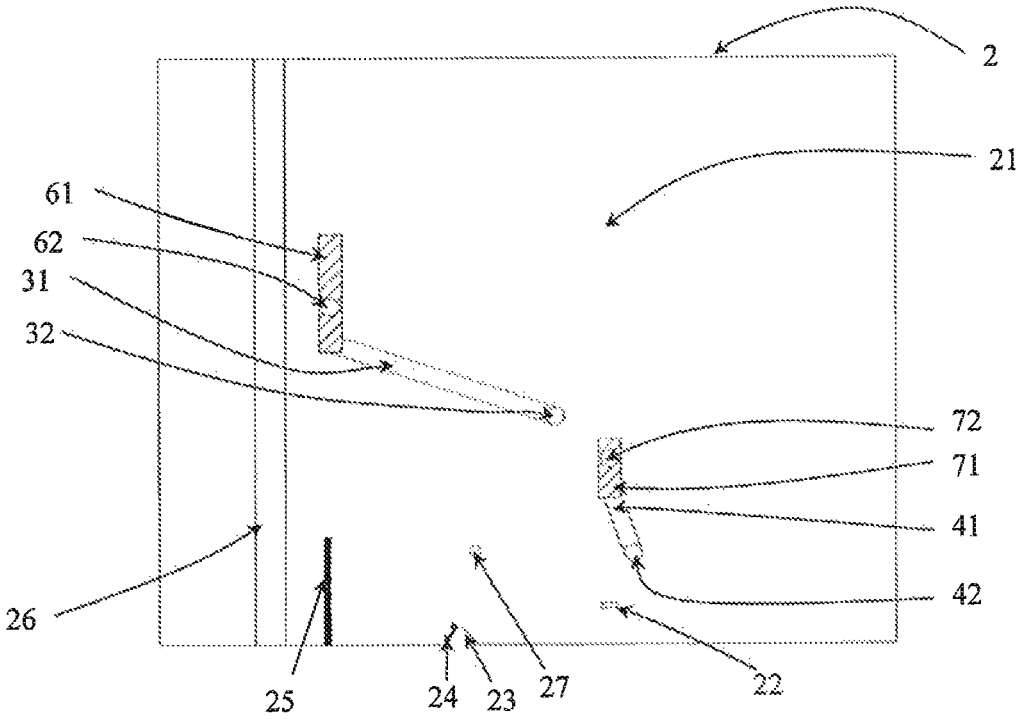
FIG. 8 represents a profile vie of a pier from inside the structure.
Figure 9C:
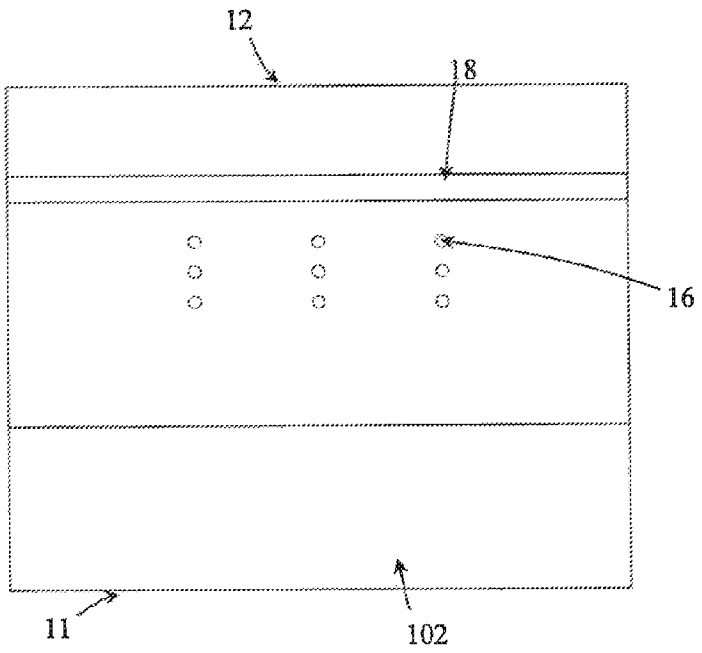
FIG. 9 represents the body of a valve, in a profile view (FIG. 9*a*), section view (9*b*) and downstream front view (9*c*)
Figure 9B:
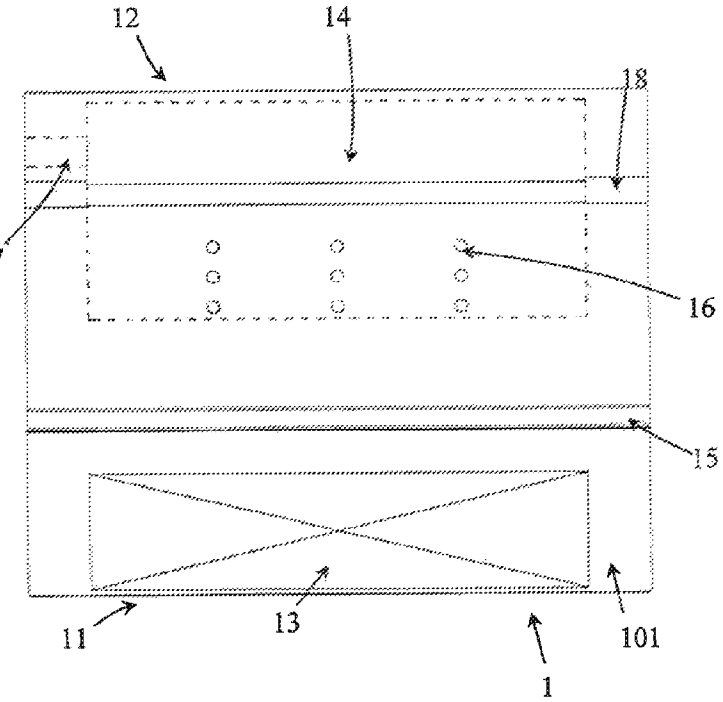
Figure 9A:
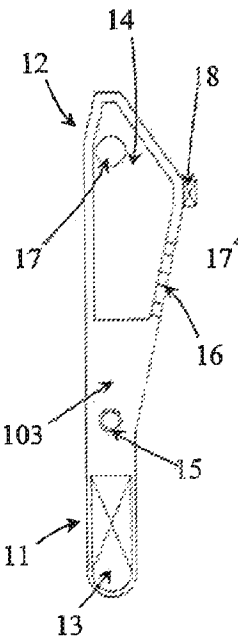

When the valve is closed, and there is no more overflow, the normal support level is represented by the level 56 in FIG. 6. The valve is kept in the closed position (when the body bears on the abutment 23 of the base 8) in that the resultant of the hydrostatic forces, the counterweight 13 and the weight of the valve creates a momentum which keeps the valve closed.

In FIG. 1, the valve is closed. The level 51 is the level above which the overflow above the valve body 1 occurs.

Figure 2:
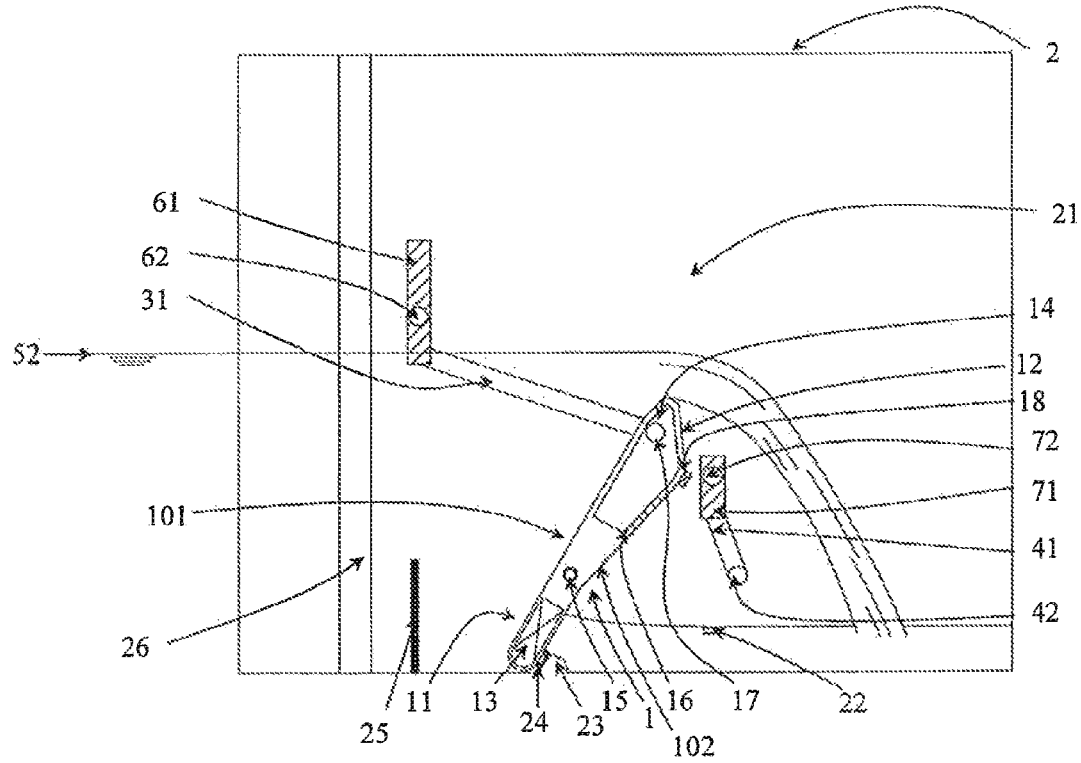

In FIG. 2, the overflow occurs over the crest consisting of the top edge of the body 1. The reservoir 14 remains empty; the level 52 is below the port 62.

In FIG. 3, the water level 53 has reached the level of the hole 62. The valve is closed. Water continuous to overflow over the body 1, while the reservoir 14 is filled, with the water first flowing via the water intake, i.e. the hole 62, and the conduit 31, the port 32 and the port 17 of the reservoir 14.

Once the reservoir has been filled, the hydrostatic forces and the weight of the reservoir 14 outweigh the weight of the counterweight 13. The falling momentum becomes greater than the holding momentum. The body 1 pivots about the axis 15, changes to the horizontal position and is held there while the water level is above the hole 72, for example at the level 54.

The sheet of water above the body 1 and the weight of the water in the reservoir 14 keep the valve open.

When the water level in the basin falls, to below the level of the hole 72, for example by reaching the level 55, the overflow over the body 1 continues but the reservoir 14 is no longer filled and is then drained via the draining ports 16. The sum of the momentums of the forces tends to return the body 1 to the closed position. Overflow no longer occurs.

Figure 10:
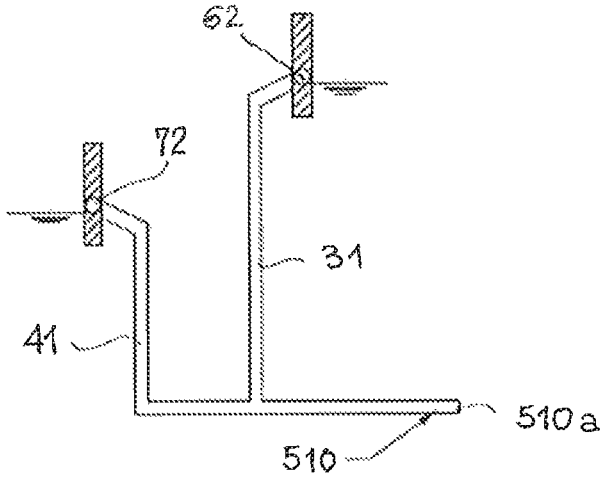
FIG. 10 shows a side view of a two-level structure for supplying the body.

FIG. 10 shows a two-level supply structure embodiment of the body 1. The second conduit 41, separate from the body 1, is connected to the first conduit 31 in a lower position than the levels of respective water intakes 72, 62. The two conduits 31, 41 are thus connected together at the filling port 17 by a common section 510. This connection to the port 17 is permanent, whether the valve is closed or open. The water intake 72 of the second conduit 41 is located at a lower position than the water intake 62 of the first conduit 31. The end 510*a* is connected to that 510*b* in FIG. 11 downstream whereof the permanent connection is situated (unlike those, 32, 42, which are different and temporary), with the valve both open or closed, to the port 17 for accessing the reservoir 14 of the tipping body 1.

It is recommended that the common section 510 is at least locally deformable (particularly in respect of length), in this case in 511, to follow the pivoting of the body 1 about the horizontal axis 15 thereof.

Figure 11:
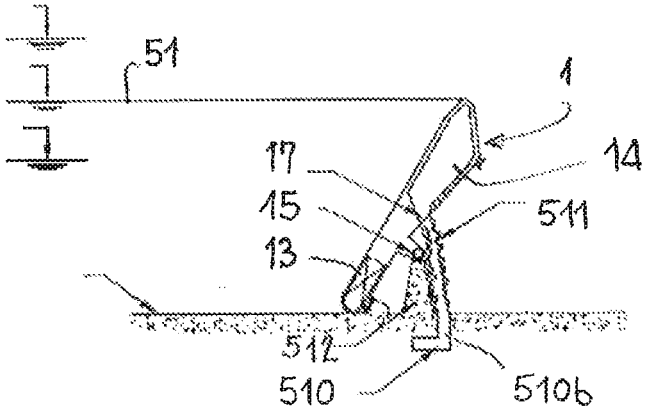
FIG. 11 shows a vertical section view of an adjustable valve installation on platforms.

In FIG. 11, the water rises to the level 51, as in FIG. 1.

Figure 13:
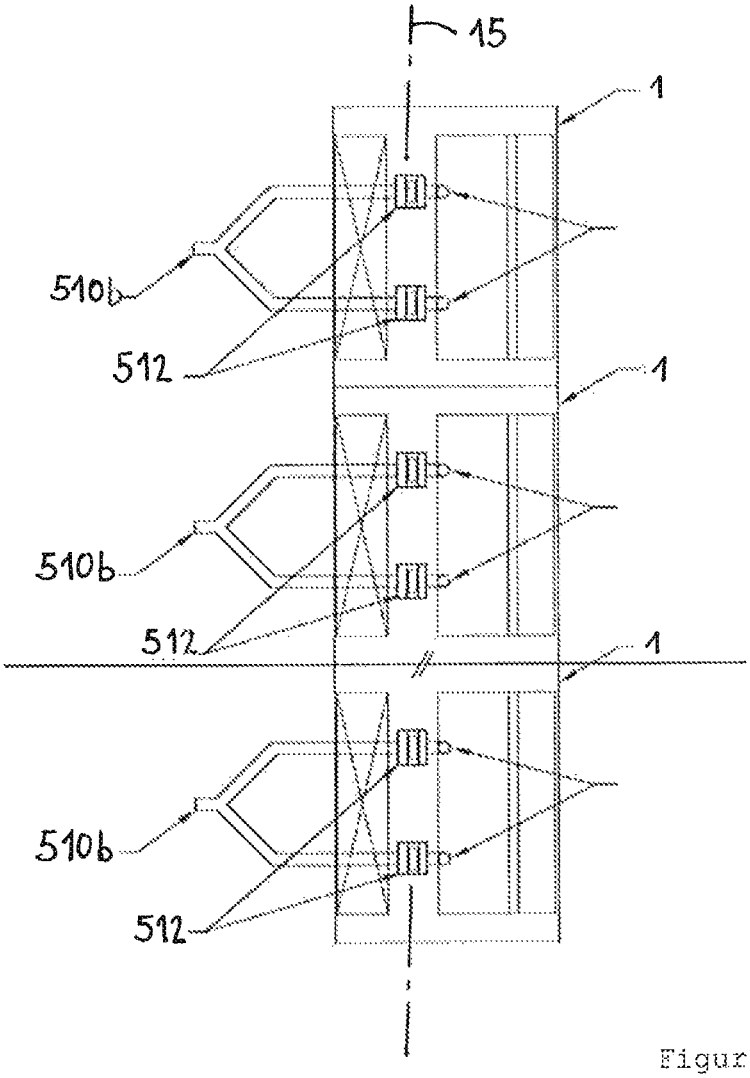
FIG. 13 shows a plan view of an installation of a plurality of valve bodies side by side on platforms.

FIGS. 11 and 13 show an embodiment wherein each body 1 (FIG. 13 shows three bodies 1 side by side, aligned parallel with the axis 15) has an axial pivot 15 mounted between two platforms 512. In FIG. 13, 510*b* is again the position of the connection to the supply structure, whether referring to that in FIG. 10 (end 510*a*), or to that of another alternative embodiment described and/or illustrated.

Figure 12:
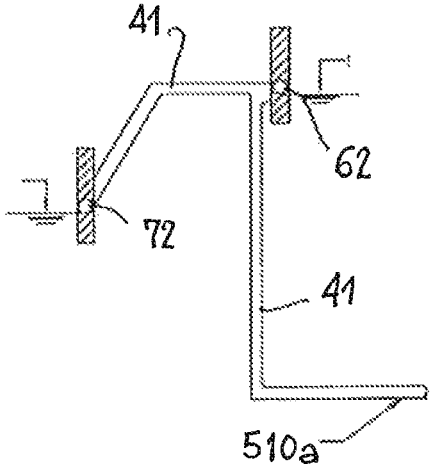
FIG. 12 shows a profile view of a solution fulfilling the constraint of supplying water to the reservoir of a valve body which is only activated after supplying the first conduit with water.

FIG. 12 shows a two-level water supply structure embodiment of the (or each) valve body 1 fulfilling the requirement of supplying water to the reservoir 14 of the (or each) body 1 which is only activated after supplying water to the first conduit 31. The second conduit 41 has a water intake 72 located at a lower position than the water intake 62 of the first conduit 31. The first conduit 31 defines, downstream from the water intake 62 thereof, a siphon for supplying the filling port 17 (which is in principle permanent) of the body with water.

The invention claimed is:

1. An adjustable automatic valve that changes between open and closed states and that includes a body that can pivot about a horizontal axis, the body comprising:

a reservoir substantially disposed above the horizontal axis, at least one filling orifice enabling entry of water for filling the reservoir and at least one draining orifice for draining the reservoir, a first pipe connected to the filling orifice and having a water intake located higher than the filling orifice whether the valve is open or closed, and a counterweight below the horizontal axis in the closed state of the valve, wherein the first pipe is separate from the body and is connected to the filling orifice when the valve is closed and disconnected therefrom when the valve is opened by pivoting of the body, and the valve includes a second pipe separate from the body connected to the filling orifice when the valve is open and disconnected therefrom when the valve is closed by pivoting of the body, the second pipe having a water intake lower than the water intake of the first pipe and higher than the horizontal axis.

2. The valve of claim 1 wherein second pipe is connected to the first pipe and permanently connected to the filling orifice by a common section of the first and second pipes whether the valve is closed or open, the second pipe having a water intake lower than the water intake of the first pipe.

3. The valve of claim 2 wherein the second pipe is connected to the first pipe so that the filling orifice is fed with water only after the first pipe is fed with water.

4. The valve of claim 3 wherein the second pipe having a water intake lower than the water intake of the first pipe and wherein the first pipe defines, downstream of the water intake of the first pipe, a siphon for feeding the filling orifice with water.

5. The valve of claim 1 wherein at least one of the pipes includes a cavity configured to adjust the water level above which the reservoir fills.

6. The valve of claim 1 wherein, with the valve closed, the water intake of the first pipe is higher than the body.

7. The valve of claim 1 wherein, with the valve open, the water intake of the second pipe is higher than the filling orifice and the body.

8. The valve of claim 1 wherein the first pipe is fixed to a fixed support element other than the body.

9. A hydraulic structure including the adjustable automatic valve of claim 1 and a fixed support element other than the body to which the first pipe is fixed.

* * * * *